US006300050B1

(12) United States Patent
Dankosh et al.

(10) Patent No.: US 6,300,050 B1
(45) Date of Patent: Oct. 9, 2001

(54) SILVER IODIDE-CONTAINING PHOTOSENSITIVE MATERIAL AND PHOTOTHERMOGRAPHIC ELEMENT FORMED THEREFROM

(75) Inventors: Heidi E. Dankosh, Rochester; Kathleen R. Gisser, Pittsford; Thomas N. Blanton, Rochester; Dilip K. Chatterjee, Rochester; Seshadri Jagannathan, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/547,091

(22) Filed: Apr. 11, 2000

Related U.S. Application Data

(60) Division of application No. 09/216,530, filed on Dec. 18, 1999, now abandoned, which is a continuation-in-part of application No. 08/939,465, filed on Sep. 29, 1997, now abandoned.

(51) Int. Cl.[7] ..... G03C 1/00
(52) U.S. Cl. ..... 430/567; 430/619
(58) Field of Search ..... 430/567, 569, 430/619

(56) References Cited

U.S. PATENT DOCUMENTS

| | | | |
|---|---|---|---|
| 3,457,075 | | 7/1969 | Morgan et al. . |
| 3,932,189 | | 1/1976 | Kaneda et al. . |
| 3,933,508 | * | 1/1976 | Ohkubo et al. . |
| 4,002,479 | | 1/1977 | Suzuki et al. . |
| 4,109,063 | | 8/1978 | Dunn . |
| 4,135,040 | | 1/1979 | Thornton . |
| 4,142,900 | * | 3/1979 | Maskasky . |
| 4,142,945 | | 3/1979 | Dunn et al. . |
| 4,230,256 | | 10/1980 | Dunn et al. . |
| 4,332,889 | | 6/1982 | Siga et al. . |
| 4,879,904 | | 11/1989 | Shaw et al. . |
| 4,895,024 | | 1/1990 | Shaw . |
| 4,941,355 | | 7/1990 | Richert . |
| 5,080,775 | | 1/1992 | Yamauchi et al. . |
| 5,322,611 | | 6/1994 | Zaromb . |
| 5,405,718 | | 4/1995 | Hashemi . |

FOREIGN PATENT DOCUMENTS

| | | |
|---|---|---|
| 2053499 | 2/1981 | (GB) . |

OTHER PUBLICATIONS

The Theory of Photographic Process, Fourth Edition, T.H. James, 1977.*

*Research Disclosure*, Jun. 1978, Item No. 17029.

Fast Ionic Conductors, S. Chen and H. Sato, *Encyclopedia of Physical Science and Technology*, vol. 6, 1992.

High–Conductivity Solid Electrolytes: $MAg_4I_5$, *Science*, vol. 157, Jul. 21, 1967.

* cited by examiner

*Primary Examiner*—Thorl Chea
(74) *Attorney, Agent, or Firm*—Chris P. Konkol

(57) ABSTRACT

A photosensitive material includes silver iodide produced by decomposing a solid electrolyte of the formula $MA_4g_5$ having an ionic conductivity of >0.001 $ohm^{-1}$ $cm^{-1}$ in an organic solvent, where M is a monovalent cation. The photosensitive material further includes a sensitizing agent selected from the group consisting of residual $MAg_4I_5$, $MAg_4I_3$, and mixtures of residual $MAg_4I_5$, and $MAg_4I_3$.

7 Claims, No Drawings

SILVER IODIDE-CONTAINING PHOTOSENSITIVE MATERIAL AND PHOTOTHERMOGRAPHIC ELEMENT FORMED THEREFROM

CROSS-REFERENCE TO RELATED APPLICATIONS

This is a divisional of application Ser. No. 09/216,530 filed Dec. 18, 1999, now abandoned, which is a C-I-P of Ser. No. 08/939,465 filed Sep. 29, 1997 now abandoned, the entire disclosures of which are incorporated by reference.

FIELD OF THE INVENTION

This invention relates to photothermographic elements, a method of preparing said elements and a method of preparing a light sensitive silver halide emulsion.

BACKGROUND OF THE INVENTION

Thermally processable imaging elements, including films and papers, for producing images by thermal processing are well known. These elements include photothermographic elements in which an image is formed by imagewise exposure to light followed by development by uniformly heating the element. Such elements typically include photosensitive silver halide, prepared in situ and/or ex situ, as a photosensitive component, in combination with an oxidation-reduction image forming combination, such as silver behenate with a phenolic reducing agent. Such elements are described in, for example, Research Disclosure, June, 1978, Item No. 17029, U.S. Pat. Nos. 3,457,075; and 3,933,508.

Photothermographic elements are typically processed by a method which comprises imagewise exposure of the element to actinic radiation to form a latent image therein followed by heating of the imagewise-exposed element to convert the latent image to a visible image. The simplicity of this method is highly advantageous. Photothermographic elements have been described heretofore in numerous patents.

PROBLEM TO BE SOLVED BY THE INVENTION

The problem to be solved by this invention is to provide photothermographic elements having improved the photosensitivity, in particular, photothermographic elements comprising a silver halide emulsion in which the silver halide comprises at least 10% silver iodide, and a method of making such photothermographic elements.

SUMMARY OF THE INVENTION

We have now discovered that preparing a silver halide emulsion with the use of a solid ionic conductor increases the speed (i.e. photosensitivity) of the silver halide emulsion.

One aspect of this invention comprises a photothermographic element comprising a support bearing an imaging layer comprising:

a silver salt;

a reducing agent;

a binder; and a photosensitive material comprising silver iodide produced by dispersing a solid ionic conductor of the formula $MAg_4I_5$ in an organic solvent, whereby the ionic conductor decomposes to produce silver iodide, and wherein M is a monovalent cation and said solid ionic conductor has an ionic conductivity of >0.001 $ohm^{-1}$ $cm^{-1}$ at 25° C.

Another aspect of this invention comprises a method of preparing a photothermographic element comprising:

dispersing a binder in an organic solvent;

adding to the resulting dispersion a solid ionic conductor of the formula $MAg_4I_5$ having ionic conductivity of >0.001 $ohm^{-1}$ $cm^{-1}$, then adding a silver salt and a reducing agent, to the dispersion; and coating the resulting dispersion onto a support.

Yet another aspect of this invention comprises a method of preparing a light sensitive silver iodide emulsion which comprises dispersing, in an organic solvent, a solid ionic conductor of the formula $MAg_4I_5$, whereby the solid ionic conductor decomposes to produce silver iodide, and wherein M is a monovalent cation and the solid ionic conductor has an ionic conductivity of >0.001 $ohm^{-1}$ $cm^{-1}$.

The solid ionic conductor preferably has an ionic conductivity between 0.001 $ohm^{-1}$ $cm^{-1}$ and 0.5 $ohm^{-1}$ $cm^{-1}$.

ADVANTAGEOUS EFFECT OF THE INVENTION

This invention provides photothermographic elements having increased speed (i.e., photosensitivity). In preferred embodiments, this invention provides a process for generating photothennographic elements, having increased photosensitivity, that may be regarded as an alternative to solution precipitation. In contrast to the conventional approach to generating photothermographic elements, which involves mixing a solution containing silver ions with a solution containing halide ions. In the process described in this invention, a powder of a solid ionic conductor, such as RbAg415, which is generated by melt crystallization and ball milling, is dispersed in a suitable organic solvent such as acetone, to undergo decomposition and generate the photothermographic elements. A significant advantage of this process is the elimination of the precipitation step which utilizes a significant quantity of organic solvents; i.e. minimizes the quantity of waste solvent generated during the process. Hence this process may be regarded as an environmentally friendlier process. In addition, the photothermographic elements generated by this process appear to have enhanced photosensitivity compared to the analogous elements generated by solution preparation.

DETAILED DESCRIPTION OF THE INVENTION

This invention provides silver halide emulsion in an organic solvent having improved speed. This is achieved by the use of solid ionic conductors comprising silver and halide ions. In preferred embodiments of the invention, the solid ionic conductor comprises silver and iodide ions. The solid ionic conductor preferably comprises a compound of the formula $MAg_4X_5$ where M is monovalent cation and X is a halide ion. Illustrative cations for use in the solid ionic conductor include, for example, $Na^+$, $K^+$, $Rb^+$, $Cs^+$ or $NH_4^+$. The organic solvent is preferably a polar, solvent, such as acetone and methyl isobutyl ketone.

In a preferred embodiment of the invention the silver halide emulsion is prepared in situ by decomposing the compound $MAg_4X_5$ in the organic solvent. The compound $MAg_4X_5$ is prepared from AgX and MX by melt crystallization followed by ball milling to produce a fine powder. This powder is then dispersed in the organic solvent.

It is believed that the following represents the decomposition reaction:

$$2MAg_4X_5 \rightarrow M_2AgX_3 + 7AgX.$$

In preferred embodiments of the invention X is iodide.

While not wishing to be bound by any theory, it is believed that the AgI may be chemically sensitized by trace amounts of $MAg_4I_5$, by $M_2AgI_3$ (one of the decomposition products) or by some other material generated during the decomposition process. In any event, we have discovered that $MAg_4I_5$ decomposed in the presence of acetone has enhanced photosensitivity.

The photothermographic elements utilized in this invention can be black-and-white imaging elements or dye forming elements, including elements adapted for dye image transfer to an image receiver layer. Illustrative of the many patents describing photothermographic elements are U.S. Pat. Nos. 3,457,075, 3,764,329, 3,802,888, 3,839,049, 3,871,887, 3,933,508, 4,260,667, 4,267,267, 4,281,060, 4,283,477, 4,287,295, 4,291,120, 4,347,310, 4,459,350, 4,741,992, 4,857,439 and 4,942,115.

The photothermographic elements as described in the prior art comprise a variety of supports. Examples of useful supports include poly(vinyl acetal) film, polystyrene film, poly(ethyleneterephthalate) film, polycarbonate films and related films and resinous materials, as well as glass, paper, metal, and other supports that can withstand the thermal processing temperatures.

The layers of the photothermographic element are coated on the support by coating procedures known in the photographic art, including dip coating, air knife coating, curtain coating or extrusion coating using coating hoppers. If desired, two or more layers are coated simultaneously.

Commonly utilized photothermographic elements comprise a support bearing, in reactive association, in a binder, such as poly(vinyl butyral), (a) photosensitive silver halide, prepared ex situ and/or in situ, and (b) an oxidation-reduction image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent. The photothermographic silver halide element can comprise other addenda known in the art to help in providing a useful image, such as optional toning agents and image stabilizers. A preferred photothermographic element comprises a support bearing, in reactive association, in a binder, particularly a poly(vinyl butyral) binder, (a) photographic silver halide, prepared in situ and/or ex situ, (b) an oxidation-reduction image forming combination comprising (i) silver behenate, with (ii) a phenolic reducing agent for the silver behenate, (c) a toning agent, such as succinimide, and (d) an image stabilizer, such as 2-bromo-2-(4-methylphenylsulfonyl)acetamide.

The photothermographic element typically has an overcoat layer that helps protect the element from undesired marks. Such an overcoat can be, for example, a polymer as described in the photothermographic art. Such an overcoat can also be an overcoat comprising poly(silicic acid) and poly(vinyl alcohol) as described in U.S. Pat. No. 4,741,992.

The optimum layer thickness of the layers of the photothermographic element depends upon such factors as the processing conditions, thermal processing means, particular components of the element and the desired image. The layers typically have a layer thickness within the range of about 1 to about 10 microns.

The photothermographic element comprises a photosensitive component that consists essentially of photographic silver halide. In the photothermographic element it is believed that the latent image silver from the photographic silver halide acts as a catalyst for the described oxidation-reduction image-forming combination upon processing. A preferred concentration of photographic silver halide is within the range of about 0.01 to about 10 moles of silver halide per mole of silver behenate in the photothermographic element. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful. The photographic silver halide can be prepared by any of the procedures known in the photographic art. Such procedures for forming photographic silver halide are described in, for example, Research Disclosure, December 1978, Item No. 17643 and Research Disclosure, June 1978, Item No. 17029. Tabular grain photosensitive silver halide is also useful, such as described in, for example, U.S. Pat. No. 4,453,499. The photographic silver halide can be unwashed or washed, chemically sensitized, protected against production of fog and stabilized against loss of sensitivity during keeping as described in the above Research Disclosure publications. The silver halide can be prepared in situ as described in, for example, U.S. Pat. No. 3,457,075. Optionally the silver halide can be prepared ex situ as known in the photographic art.

The photothermographic element typically comprises an oxidation-reduction image-forming combination that contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver oxidizing agents are silver behenate, silver stearate, silver oleate, silver laurate, silver caprate, silver myristate, and silver palmitate. Combinations of organic silver salt oxidizing agents are also useful. Examples of useful silver salt oxidizing agents that are not silver salts of fatty acids include, for example, silver benzoate and silver benzotriazole.

The optimum concentration of organic silver salt oxidizing agent in the photothermographic material will vary depending upon the desired image, particular organic silver salt oxidizing agent, particular reducing agent, particular fatty acids in the photothermographic composition, and the particular photothermographic element. A preferred concentration of organic silver salt oxidizing agent is typically within the range of 0.5 mole to 0.90 mole per mole of total silver in the photothermographic element. When combinations of organic silver salt oxidizing agents are present, the total concentration of organic silver salt oxidizing agents is within the described concentration range.

A variety of reducing agents are useful in the oxidation-reduction image-forming combination. Examples of useful reducing agents include substituted phenols and naphthols such as bis-beta-naphthols; polyhydroxybenzenes, such as hydroquinones; catechols and pyrogallols, aminophenol reducing agents, such as 2,4-diaminophenols and methylaminophenols, ascorbic acid, ascorbic acid ketals and other ascorbic acid derivatives; hydroxylamine reducing agents; 3-pyrazolidone reducing agents; sulfonamidophenyl reducing agents such as described in U.S. Pat. No. 3,933,508 and Research Disclosure, June 1978, Item No. 17029. Combinations of organic reducing agents are also useful.

Preferred organic reducing agents in the photothermographic materials are sulfonamidophenol reducing agents, such as described in U.S. Pat. No. 3,801,321. Examples of useful sulfonamidophenol reducing agents include 2,6-dichloro-4-benzenesulfonamidophenol; benzenesulfonamidophenol; 2,6-dibromo-4-benzenesulfonamidophenol and mixtures thereof.

An optimum concentration of reducing agent in a photothermographic material varies depending upon such factors as the particular photothermographic element, desired image, processing conditions, the particular organic silver salt oxidizing agent and manufacturing conditions for the photothermographic material. A particularly useful concentration of organic reducing agent is within the range of 0.2 mole to 2.0 mole of reducing agent per mole of silver in the photothermographic material. When combinations of organic reducing agents are present, the total concentration of reducing agents is preferably within the described concentration range.

The photothermographic material preferably comprises a toning agent, also known as an activator-toning agent or a toner-accelerator. Combinations of toning agents are useful in photothermographic materials. An optimum toning agent or toning agent combination depends upon such factors as the particular photothermographic material, desired image and processing conditions. Examples of useful toning agents and toning agent combinations include those described in, for example, Research Disclosure, June 1978, Item No. 17029 and U.S. Pat. No. 4,123,282. Examples of useful toning agents include phthalimide, N-hydroxyphthalimide, N-potassium phthalimide, succinimide, N-hydroxy-1,8-naphthalimide, phthalazine, 1-(2H)-phthalazinone and 2-acetyphthalazinone.

Stabilizers are also useful in the photothermographic material. Examples of such stabilizers and stabilizer precursors are described in, for example, U.S. Pat. Nos. 4,459,350 and 3,877,940. Such stabilizers include photolytically active stabilizers and stabilizer precursors, azole thioethers and blocked azolinethione stabilizer precursors and carbamoyl stabilizer precursors.

Photothermographic materials preferably contain various colloids and polymers, alone or in combination, as vehicles or binding agents utilized in various layers. Useful materials are hydrophobic or hydrophilic. They are transparent or translucent and include both naturally occurring substances such as proteins, for example, gelatin, gelatin derivatives, cellulose derivatives, polysaccharides, such as dextran, gum arabic and the like; and synthetic polymeric substances, such as polyvinyl compounds like poly(vinylpyrrolidone) and acrylamide polymers. Other synthetic polymeric compounds that are useful include dispersed vinyl compounds such as in latex form and particularly those that increase the dimensional stability of photographic materials. Effective polymers include polymers of alkylacrylates and methacrylates, acrylic acid, sulfoacrylates and those that have crosslinking sites that facilitate hardening or curing. Preferred high molecular weight polymers and resins include poly (vinylbutyral), cellulose acetate butyrals, poly (methylmethacrylate), poly(vinyl pyrrolidone), ethyl cellulose, polystyrene, poly(vinyl chloride), chlorinated rubbers, polyisobutylene, butadiene-styrene copolymers, vinyl chloride-vinyl acetate copolymers, poly(vinyl alcohols) and polycarbonates.

The photothermographic materials can contain development modifiers that function as speed increasing compounds, sensitizing dyes, hardeners, antistatic layers, plasticizers and lubricants, coating aids, brighteners, absorbing and filter dyes, and other addenda, such as described in Research Disclosure, June 1978, Item No. 17029 and Research Disclosure, December 1978, Item No. 17643.

A photothermographic element, as described, also preferably comprises a thermal stabilizer to help stabilize the photothermographic element prior to imagewise exposure and thermal processing. Such a thermal stabilizer aids improvement of stability of the photothermographic element during storage. Typical thermal stabilizers are: (a) 2-bromo-2-arylsulfonylacetamides, such as 2-bromo-2-p-tolylsulfonylacetamide; (b) 2-(tribromomethyl sulfonyl) benzothiazole and (c) 6-substituted-2,4-bis (tribromomethyl)-S-triazine, such as 6-methyl or 6-phenyl-2,4-bis(tribromomethyl)-s-triazine. Heating means known in the photothermographic art are useful for providing the desired processing temperature. The heating means is, for example, a simple hot plate, iron, roller, heated drum, microwave heating means, heated air or the like.

Thermal processing is preferably carried out under ambient conditions of pressure and humidity. Conditions outside normal atmospheric conditions can be used if desired.

The components of the photothermographic element can be in any location in the element that provides the desired image. If desired, one or more of the components of the element can be distributed between two or more of he layers of the element. For example, in some cases, it s desirable to include certain percentages of the organic reducing agent, toner, stabilizer precursor and/or other addenda in an overcoat layer of the photothermographic element.

It is necessary that the components of the imaging combination be "in association" with each other in order to produce the desired image. The term "in association" herein means that in a photothermographic element the photosensitive silver halide and the image-forming combination are in a location with respect to each other that enables the desired processing and produces a useful image.

The photothermographic elements of this invention are typically provided with an overcoat layer and/or a backing layer, with the overcoat layer being the outermost layer on the side of the support on which the imaging layer is coated and the backing layer being the outermost layer on the opposite side of the support. Other layers which are advantageously incorporated in photothermographic imaging elements include subbing layers and barrier layers.

To be fully acceptable, a protective overcoat layer for such imaging elements should: (a) provide resistance to deformation of the layers of the element during thermal processing, (b) prevent or reduce loss of volatile components in the element during thermal processing, (c) reduce or prevent transfer of essential imaging components from one or more of the layers of the element into the overcoat layer during manufacture of the element or during storage of the element prior to imaging and thermal processing, (d) enable satisfactory adhesion of the overcoat to a contiguous layer of the element, and (e) be free from cracking and undesired marking, such as abrasion marking, during manufacture, storage, and processing of the element.

A backing layer also serves several important functions which improve the overall performance of photothermographic imaging elements. For example, a backing layer serves to improve conveyance, reduce static electricity and eliminate formation of Newton Rings. A particularly preferred overcoat for photothermographic imaging elements is an overcoat comprising poly(silicic acid) as described in U.S. Pat. No. 4,741,992, issued May 3, 1988. Advantageously, water-soluble hydroxyl-containing monomers or polymers are incorporated in the overcoat layer together with the poly(silicic acid). The combination of poly(silicic acid) and a water-soluble hydroxyl-containing monomer or polymer that is compatible with the poly(silicic acid) is also useful in a backing layer on the side of the support opposite to the imaging layer as described in U.S. Pat. No. 4,828,971, issued May 9, 1989.

U.S. Pat. No. 4,828,971 explains the requirements for backing layers in photothermographic imaging elements. It points out that an optimum backing layer must:

(a) provide adequate conveyance characteristics during manufacturing steps, (b) provide resistance to deformation of the element during thermal processing, (c) enable satisfactory adhesion of the backing layer to the support of the element without undesired removal during thermal processing, (d) be free from cracking and undesired marking, such as abrasion marking during manufacture, storage and processing of the element, (e) reduce static electricity effects during manufacture and (f) not provide undesired sensitometric effects in the element during manufacture, storage or processing.

A wide variety of materials can be used to prepare a backing layer that is compatible with the requirements of photothermographic imaging elements. The backing layer should be transparent and colorless and should not adversely affect sensitometric characteristics of the photothermographic element such as minimum density, maximum density and photographic speed. Preferred backing layers are those comprised of poly(silicic acid) and a water-soluble hydroxyl containing monomer or polymer that is compatible with poly(silicic acid) as described in U.S. Pat. No. 4,828,971. A combination of poly(silicic acid) and poly(vinyl alcohol) is particularly useful. Other useful backing layers include those formed from polymethylmethacrylate, cellulose acetate, crosslinked polyvinyl alcohol, terpolymers of acrylonitrile, vinylidene chloride, and 2-(methacryloyloxy) ethyltrimethylammonium methosulfate, crosslinked gelatin, polyesters and polyurethanes.

In the photothermographic imaging elements of this invention, either organic or inorganic matting agents can be used. Examples of organic matting agents are particles, often in the form of beads, of polymers such as polymeric esters of acrylic and methacrylic acid, e.g., poly (methylmethacrylate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

The backing layer preferably has a glass transition temperature (Tg) of greater than 50° C., more preferably greater than 100° C., and a surface roughness such that the Roughness Average (Ra) value is greater than 0.8, more preferably greater than 1.2, and most preferably greater than 1.5.

As described in U.S. Pat. No. 4,828,971, the Roughness Average (Ra) is the arithmetic average of all departures of the roughness profile from the mean line. The concentration of matting agent required to give the desired roughness depends on the mean diameter of the particles and the amount of binder. Preferred particles are those with a mean diameter of from about 1 to about 15 micrometers, preferably from 2 to 8 micrometers. The matte particles can be usefully employed at a concentration of about 1 to about 100 milligrams per square meter.

The following examples illustrate the preparation of silver iodide having improved photosensitivity and its use in photothermographic elements.

EXAMPLE 1

This example illustrates the preparation of $RbAg_4I_5$.

$RbAg4I_5$ was generated by dissolving RbI in molten AgI, rather than by the solid state diffusion of Rb in AgI to form $RbAg_4I_5$. This procedure ensured complete homogeneity and prevented phase separation. Stoichiometric amounts of AgI and RbI were ground and melted in an alumina crucible at 580° C. (this temperature is slightly higher than the melting point of AgI, 555° C.) in flowing argon gas. The alumina crucible was wrapped with aluminum foil to prevent exposure of the melt to ambient light. After five minutes at 580° C., the molten material was allowed to cool to room temperature over a period of 24 hours.

The ingot of $RbAg4I_5$ compound was then ground and ball milled in black containers using 2 mm diameter zirconia balls for about five hours. The resultant material was characterized by X-ray diffraction (XRD), and found to be ca. 99% RbAg415.

EXAMPLE 2

This example illustrates the preparation and evaluation of photothermographic elements of the invention.

Check Sample

A photothermographic element was prepared as follows:

An emulsion was prepared containing 1.067 g silver bromide, and 10 ml of a 5% solution of a poly(vinyl butyral), Butvar™ B-76 from Monsanto, in acetone. Then a photothermographic layer containing the above emulsion (4.17 g), silver behenate (9.26 g in toluene/5% Butvar B-76, 4.25% by weight Ag), succinimide (1.41 g, 10% in toluene/5% Butvar B-76), and benzene sulfonimidophenol (3.73 g, 10% in toluene/5% Butvar B-76). was coated onto a polyester support.

Sample 1

A photothermographic element was prepared as above, except acetone decomposed RbA&I, prepared as in Example 1 was used in place of silver bromide.

X-ray diffraction (XRD) analysis of the coated emulsion indicates that the acetone decomposed $RbAg_4I_5$ is primarily βAgI, with a small quantity of $Rb_2AgI_3$.

Sample 2

A photothermographic element was prepared as above, except AgI(γ) emulsion was used in place of the silver bromide.

AgI(γ) was prepared by ball milling a dispersion of silver iodide powder as an emulsion in a 5% solution of Butvar in acetone.

XRD analysis indicates that the emulsion contains primarily AgI(γ).

Sample 3

A photothermographic element was prepared as above, except AgI(β) was used in place of the silver bromide.

AgI(β) was prepared by precipitating AgI from the silver salt of trifluoroacetic acid and LiI in a 5% solution of Butvar in acetone.

XRD analysis indicates that the emulsion contains primarily AgI(β).

Sample 4

A photothermographic element was prepared as above, except an emulsion containing AgI(β) and a small amount of $Rb_2AgI_3$ was used in place of the silver bromide emulsion.

The emulsion containing AgI and a small amount of $Rb_2AgI_3$ was prepared by precipitating AgI from the silver salt of trifluoroacetic acid and LiI in a 5% solution of Butvar in acetone containing small quantities of RbI.

XRD analysis of the emulsion indicates the presence of a small amount of $Rb_2AgI_3$.

The above samples were evaluated for their photothennographic properties as follows:

The photothermographic element was slit into strips and the strips were exposed for $10^{-3}$ seconds with an EG&G sensitometer through a 0–4 density step tablet. The exposed strips were processed at 119° C. for 5 seconds. The silver image densities for the step tablet exposures were measured using a blue filter in a computer densitometer.

The results are given in the table.

TABLE

| id | description | speed | Dmin | Dmax |
|---|---|---|---|---|
| Check | AgBr | 215 | 0.20 | 3.32 |
| Sample 1 | decomposed $RbAg_4I_5$ | 271 | 0.61 | 3.59 |
| Sample 2 | AgI(γ) | — | 0.26 | 0.33 |
| Sample 3 | AgI(β) | 263 | 0.46 | 2.81 |
| Sample 4 | RbI + AgI | 226 | 1.36 | 2.61 |

The results show that decomposed $RbAg_4I_5$ is superior to the AgBr check; that AgI(β) is superior to AgI(γ) and that AgI(β) containing a small amount of $Rb_2AgI_3$ is inferior to decomposed $RbAg_4I_5$.

The invention has been described in detail with particular reference to certain preferred embodiments thereof, but it will be understood that variations and modifications can be effected within the spirit and scope of the invention.

What is claimed is:

1. A photosensitive material comprising silver iodide produced by decomposing a solid electrolyte of the formula $MAg_4I_5$ having an ionic conductivity of >0.001 $ohm^{-1}$ $cm^{-1}$ in an organic solvent, where M is a monovalent cation, said photosensitive material further comprising a sensitizing agent selected from the group consisting of residual $MAg_4I_5$, $MAg_4I_3$, and mixtures of said residual $MAg_4I_5$ and said $MAg_4I_3$.

2. A photosensitive material according to claim 1, wherein M is $Na^+$, $K^+$, $Rb^+$, $Cs^+$ or $NH_4^+$.

3. A photosensitive material according to claim 2, wherein M is $Rb^+$.

4. A photosensitive material according to claim 1 wherein said solid electrolyte of the formula $MAg_4I_5$ is formed by melting together stoichiometric amounts of MI and AgI, followed by cooling to solidify said $MAg_4I_5$.

5. A photosensitive material according to claim 1 wherein said decomposing is carried out in the presence of acetone.

6. A photosensitive material according to claim 1 wherein said silver iodide comprises β silver iodide.

7. A photothermographic element comprising the photosensitive material according to claim 1.

* * * * *